131-349
7/1/86 X3 4,597,397

United States Patent [19]

Weinert

[11] Patent Number: 4,597,397

[45] Date of Patent: Jul. 1, 1986

[54] CIGAR CARTRIDGE WITH A SELF IGNITING CIGAR

[76] Inventor: Friedrich Weinert, 219-19-131st Ave., Jamaica, N.Y. 11413

[21] Appl. No.: 663,199

[22] Filed: Oct. 22, 1984

Related U.S. Application Data

[63] Continuation-in-part of Ser. No. 358,855, Mar. 17, 1982, Pat. No. 4,491,139.

[51] Int. Cl.[4] ..... A24D 1/08

[52] U.S. Cl. ..... 131/351; 131/349

[58] Field of Search ..... 131/351, 349, 174, 175, 131/187

[56] References Cited

U.S. PATENT DOCUMENTS

| | | | |
|---|---|---|---|
| 1,153,419 | 9/1915 | Birmeley | 131/351 |
| 1,581,451 | 10/1925 | Knapp | 131/349 |
| 1,792,430 | 2/1931 | Kruggely | 131/349 |
| 2,006,591 | 7/1935 | Fox | 131/351 |
| 2,721,558 | 10/1955 | Griffiths | 131/351 |
| 4,491,139 | 1/1985 | Weinert | 131/351 |

*Primary Examiner*—Vincent Millin
*Assistant Examiner*—H. Macey

[57] ABSTRACT

A self igniting cigar stored in a tubular cartridge which is divided in three sections. The sections are secured through a sealed tape. When the sealed tape is removed the upper section can be pulled up from the middle section exposing the mouth piece of the cigar, allowing a smoker to grip the cigar to pull the cigar out of the remaining cartridge. This will ignite an igniting unit installed inside the cigar in the form of a flammable tube in which a piston is inserted attached to a string. The other end of string is anchored to the bottom surface of the cartridge. Therefore, when the cigar is pulled out of the cartridge, the piston is pulled out of the igniting tube, thereby igniting flammable substance in the igniting unit which ignites the cigar. The middle section is separated so that it can slide over the cigar to protect fingertips of smoker and to extinguish the butt.

1 Claim, 4 Drawing Figures

CIGAR CARTRIDGE WITH A SELF IGNITING CIGAR

CROSS-REFERENCE TO RELATED APPLICATIONS

This application is a continuation-in-part of application Ser. No. 358,855 filed Mar. 17, 1982, now U.S. Pat. No. 4,491,139.

TECHNICAL FIELD

The present invention relates to a cigar in combination with a cigar cartridge having an ignition device therebetween. When the cigar is pulled out of the cartridge, the ignition device automatically activates and an end of the cigar is lit.

BACKGROUND OF THE INVENTION

Smoking causes many fires in the United States every year. A significant number of these smoking related fires are caused by matches used to light smoking articles. Therefore, the inventor has designed a cigar cartridge which enables the lighting of a cigar without the use of a conventional match. The ignition process described in U.S. Pat. No. 4,491,139 is incorporated herein.

A further object of the invention is to avoid the ignition gases of the match to be inhaled by the smoker.

Another advantage of the invention is improved cigar lighting capability in bad weather conditions.

Furthermore, automobile drivers need not light the cigar after pulling the cigar out of the cartridge. Finally, the mid-section of the cigar is provided with an extinguishing band to extinguish the cigar when unattended.

SUMMARY OF THE INVENTION

In accordance of the invention there is provided a cigar cartridge which stores a self igniting cigar. The tubular cartridge consists of three sections whereby the upper and lower end section are fitted over midsection in form of a collar and a seal tape whereby tape secures both sections. In order to pull the cigar out of cartridge one has to remove a tape of the upper section, in order to separate top section from midsection. This exposes the front end of the cigar in order to grip the cigar with fingertips to pull the cigar out of cartridge at once. This will activate igniting unit installed at the other end of cigar. Now bottom section of cartridge is removed and disposed in the same way as upper section, leaving middle section which is now put over the cigar used as a protection shield for the smoker's fingers which slides freely alongside of the cigar, whereby at the end of the smoking procedure the butt is concealed inside midsection which will automatically extinguish butt of the cigar thereby reducing fire hazards.

DETAILED DESCRIPTION OF A PREFERRED EMBODIMENT

Figure 1:
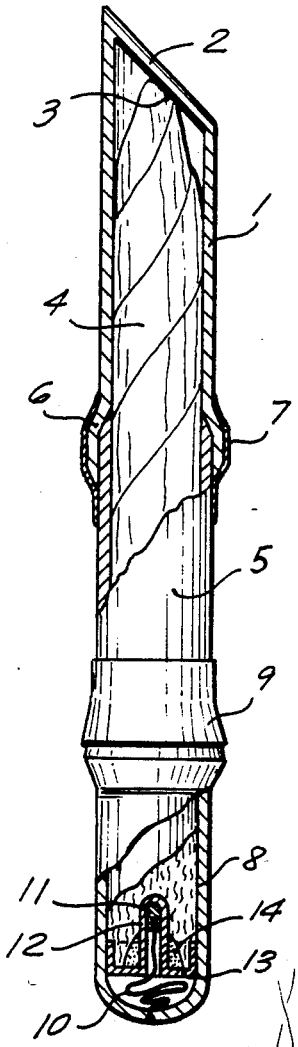
FIG. 1 is a partly sectional explanatory view of a cigar cartridge with a self igniting cigar in neutral position.

Referring to FIG. 1, there is a tubular cartridge in cross section to show the igniting unit inside the cigar and matching surface of top section (1) with middle section (5) meaning the cartridge is divided into three sections joined together by an overlapping collar (6) which matches over the edge of midsection (5) whereby edges of top and bottom section are secured by a sealed tape (7 and 9). The mouthpiece of a cigar (3) having a flat planar surface, the surface disposed at an acute angle with respect to the longitudinal axis of the cigar. This surface (3) is matched with the enclosing surface (2) of cartridge (1). This prevents cigar (4) from rotating inside the cartridge. When the top section is removed the cigar is exposed to its ambient surrounding as shown in FIG. 2.

Figure 2:
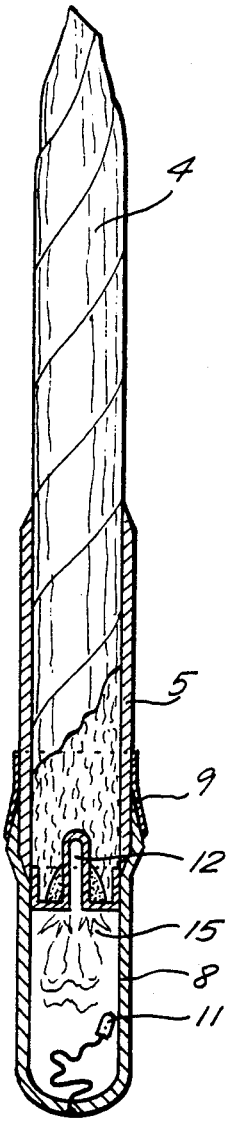
FIG. 2 is a partly sectional explanatory view of a cigar in ignition.
Figure 3:
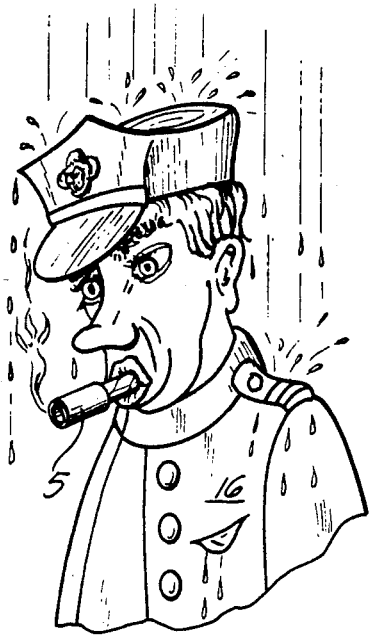
FIG. 3 is a perspective view of a self igniting cigar covered with midsection of cartridge.

This allows a smoker to pull the cigar—FIG. 2(4)—out of the remaining cartridge (5 and 8). Now bottom section (8) can be disconnected from midsection (5) by removing sealed tape (9) and pulling lower section (8) away from cartridge, leaving middle section (5) now separated from top section (1) and bottom section (8). At this stage the cigar is lit and ventilated by the smoker for smoking purposes as shown in FIG. 3.

Figure 4:
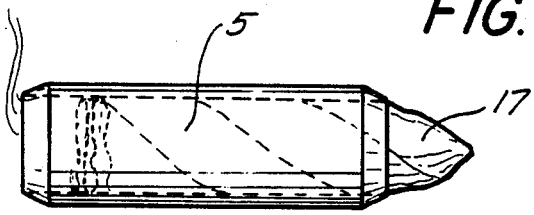
FIG. 4 is a plan view of midsection of cartridge concealing the butt of a cigar.

Now smoker (16) can take advantage of middle section (5) to slide the midsection over the cigar to protect the cigar from rain downfall and his fingertips from being exposed to the glowing tobacco. Additionally, as the cigar becomes smaller the midsection is moved inward towards the smoker's lips where the final stage, as shown in FIG. 4, midsection (5) conceals the butt (16) of cigar to extinguish butt.

The igniting unit is inserted at the front end of cigar as shown in FIGS. 1 and 2. At the very end inside igniting tube (12) is a mobile piston placed (11) which is fixed to a string (10) which has a loose end fixed against the bottom surface of bottom section (8). The igniter tube is fixed against a plate (13) which covers the front end of cigar. Edges of bottom plate (13) overlapping the outer circumference of the cigar provide a good grip when glued against it. The flammable part of the igniting tube is surrounded on the outside by a cotton filter (14). The purpose of the cotton filter is to prevent toxic gases produced during ignition entering into the tobacco of cigar, but instead being channeled through the opening of the igniting tube into the atmosphere and only after cotton filter (14) and bottom plate (13) is under fire the tobbaco is ignited by the flame. Therefore, the filter (14) and bottom plate (13) is made of a material which does not produce toxic gases like tobacco, cotton or paper. When the cigar is pulled out of cartridge as shown in FIG. 2, friction piston (11) is pulled out of igniting tube (12). This ignites flammable substance at the opening of igniting tube and bottom plate as indicated through flames (15).

While there have been shown and described, and pointed out the fundamental features of the invention as applied to a preferred embodiment, it will be understood that various omissions and substitutions and changes in the form and detail of the device illustrated in its detail may be made by those skilled in the art without departing from the scope of the invention.

I claim:

1. A cigar in combination with a tubular cigar cartridge with a self-igniting device wherein the cigar has a mouth end having a flat planar surface, the surface disposed at an acute angle with respect to the longitudinal axis of the cigar; the cartridge enclosing the cigar comprising a top, middle and bottom section; the top and bottom sections each comprising a tube having a closed and open end, the top section closed end having a cigar rotation limiting means for preventing the cigar from rotating and prematurely igniting comprising a slanted planar surface disposed at substantially the same angle as the cigar mouth end surface and contacting the same; the middle section being fireproof and cylindrical and having two open ends wherein the top and bottom section open ends overlap the middle section open ends and are attached thereto by a tape seal means for preventing rotation of any section with respect to another, whereby after breaking the seals the middle section is slidable with respect to the cigar; the igniting device comprises an igniting tube inserted into the cigar end opposite the mouth end having a central portion chemically treated with a flammable substance that will ignite upon friction, a piston inserted into the igniting tube and frictionally fitted therein, a string with one end attached to the piston and the other end attached to the closed end of the cartridge bottom section so that when the string is pulled the piston will frictionally engage the central portion so as to ignite the flammable substance, and a gas filter on the outside of the igniting tube and surrounding the same to limit toxic gases from penetrating into the cigar.

* * * * *